United States Patent [19]

Przytulla

[11] Patent Number: 5,033,639

[45] Date of Patent: Jul. 23, 1991

[54] BUNGED VESSEL

[75] Inventor: Dietmar Przytulla, Sindorf, Fed. Rep. of Germany

[73] Assignee: Mauser-Werke GmbH, Bruehl, Fed. Rep. of Germany

[21] Appl. No.: 154,735

[22] Filed: Feb. 11, 1988

[30] Foreign Application Priority Data

Jan. 21, 1988 [EP] European Pat. Off. ..... 88100868

[51] Int. Cl.[5] ..... B65D 6/00

[52] U.S. Cl. ..... 220/604; 220/659; 220/661; 220/675

[58] Field of Search ..... 222/108; 220/659, 661, 220/604, 675

[56] References Cited

U.S. PATENT DOCUMENTS

| | | | |
|---|---|---|---|
| 2,673,010 | 3/1954 | Barrow | 222/108 X |
| 3,840,141 | 10/1974 | Allom et al. . | |
| 3,934,747 | 1/1976 | Needt . | |
| 3,955,705 | 5/1976 | Dubois et al. . | |
| 4,169,537 | 10/1979 | Sabreen et al. | 220/72 X |
| 4,228,122 | 10/1980 | Hammes . | |
| 4,228,911 | 10/1980 | Hammes . | |
| 4,257,527 | 3/1981 | Snyder et al. . | |
| 4,264,016 | 4/1981 | Speas | 220/5 R X |
| 4,294,374 | 10/1981 | Ames | 220/5 R X |
| 4,643,323 | 2/1987 | Schutz . | |
| 4,674,648 | 6/1987 | Przytulla | 220/72 |
| 4,736,862 | 4/1988 | Hammes et al. . | |

FOREIGN PATENT DOCUMENTS 7600621 5/1976 Fed. Rep. of Germany .

*Primary Examiner*—Michael S. Huppert
*Assistant Examiner*—Gregory L. Huson
*Attorney, Agent, or Firm*—Pennie & Edmonds

[57] ABSTRACT

Bunged vessel having solid carriage and transport rings formed in one piece with the shell of the vessel near the head surfaces of the vessel, wherein the horizontal lower edge of the ring and the vertical inner wall of the ring form the bearing surfaces for the vessel lifter. Each carriage and transport ring is connected in one piece with the vessel by a connecting ring formed of an axial prolongation of the cylindrical part of the shell of the vessel, while the bottom of the groove between the connecting ring and the part of the shell rising conically towards the head surface of the vessel is arranged at a distance below the horizontal bearing surface of the carriage and transport ring.

7 Claims, 1 Drawing Sheet

BUNGED VESSEL

BACKGROUND OF THE INVENTION

The invention relates to a bunged vessel of thermoplastic synthetic material having a central cylindrical section, opposite end surfaces and a carriage and transport ring located on the shell of the vessel adjacent at least one of the head and bottom surfaces. The transport ring is generally solid in cross-section and includes horizontal and vertical bearing surfaces for the arm of a vessel lifter to be used in transporting the vessel. The transport ring is typically formed as one piece with the shell of vessel and joined thereto by a connecting web. The connection web extends generally axially of the vessel from its outer cylindrical wall section toward the associated end surface of the vessel. The shell of the vessel also includes a conical section extending from the cylindrical section toward the head and bottom end surfaces of the vessel. The connecting web for the transport ring and the conical section of the shell of the vessel produce an annular groove therebetween.

The vessel may be a bunged vessel which is produced entirely in the blow molding process and wherein the carriage and transport rings are formed as one piece with the shell of the vessel. However, likewise known are bunged vessels wherein the cylindrical section of the shell of the vessel and the end sections of the vessel are manufactured separately from one another. End section manufactured in the injection molding process, with the carriage and transport rings situated thereon, are then welded onto the cylindrical section of the vessel in an additional operation.

Ordinarily, according to DE-GM 7,600,621 such carriage and transport rings have a cross-section with a horizontal and vertical web. The free end of the vertical web is directed towards the respective end of the vessel and the horizontal web is formed radially outward in the shell of the vessel. Because control in the critical weld-seam region of the vessel was difficult in this embodiment, the carriage and transport ring was designed so that the critical weld zones created during the molding operation are largely relieved of bending forces. With this construction, the ring, upon impact stress, elastically deforms in the peripheral direction and hence relative to the shell of the vessel. To provide for this, the attachment of the carriage and transport ring to the shell of the vessel is designed as a flexible attachment. To this end, the carriage and transport ring was connected with the vessel by an annular connecting web merging with the shell of the vessel and adjoining the horizontal bearing surface.

The annular connecting web is stressed only by harmless tensile loads which are introduced into the shell of the vessel upon lifting transporting the vessel in the vessel lifter.

In prior constructions, the annular connecting web of the carriage and transport ring merges with the shell of the vessel at a sharp angle to the axis of the vessel. This defines a groove between the carriage and transport ring and the adjacent shell part which rises conically. For reasons of providing an attachment of the ring to the shell which is as elastic as possible, the bottom of the groove terminates at the level of the horizontal bearing surface of the ring. The space between this bearing surface and the conical portion of the shell of the vessel should be very narrow in order that the stacking forces which are produced when another filled vessel is stacked on the head surface of the vessel are transmitted through the conical area of the shell directly into the rest of the shell of the vessel. U.S. Pat. No. 4,674,648 discloses such a construction. Such narrowing of this space impeded the use of a vessel lifter, which must for this reason be given a special shape.

SUMMARY OF THE PRESENT INVENTION

In order to be able to make use of any desired vessel lifter, and in particular those used for vessels of sheet metal, it is proposed pursuant to the invention that the bottom of the groove between the connecting web and the conical shell part of the vessel be arranged at a distance below the horizontal bearing surface of the carriage and transport ring. The connecting web is thus formed out of an axial lengthening of the cylindrical section of the shell of the vessel.

For vessel lifters of conventional design, this measure provides sufficient room for freely inserting the upper arm of the lifter behind the vertical bearing surface of the carriage and transport ring. In addition, it is ensured that the radial outer edge of the carriage and transport ring remains unchanged, this being the requirement for palletizability of the vessel.

Manual handling is also substantially facilitated by enlargement of the space for insertion of the lifter. By the lengthening of the connecting web relative to the earlier construction such as disclosed in the above mentioned U.S. Pat. No. 4,674,648 where the bottom of the groove between the carriage and transport ring and the adjacent shell part terminates at the level of the horizontal bearing surface, the circumferentially elastic connection to the shell is favored, as a special advantage.

Elongation of the height of the connecting web pursuant to the invention results in a web wall thickness which is the same as that of the cylindrical section of the shell. Also, the web thickness is the same as that of the conical section of the shell. Further, with the equal wall thicknesses in the connecting web and adjacent walls and the flexibility thereby obtained means that when a filled vessel falls on its side, like deformation stresses are produced in all wall cross-sections involved. Thus, no harmful peak stresses are created which could otherwise produce cracks in the shell.

In addition, with the lengthened connecting web, the swing of the carriage and transport ring into its deformed position when it strikes the ground is reduced. Hence, this reduces the change of angle at the transition from the connecting web to the cylindrical shell part. Reduction of the strains and angles of strain contributes to the relief of stresses in the material.

In a refinement of the invention, the head surface of the vessel terminates below the plane of the horizontal bearing surface of the carriage and transport ring. At the same time, the height of the conical shell part corresponds to at least the height of the carriage and transport ring. This height relationship is to be observed to ensure adequate flexibility when a filled vessel falls on its side.

It is therefore advisable to maintain a shell region in the groove of the ring tapered conically in the head surface of the vessel, to ensure a so-called crumple zone in which the main impact energy is absorbed. This is done by arranging the bottom of the groove of the respective carriage and transport ring at a distance below the horizontal bearing surface. The height of the conical shell region together with the adjoining head end surface may with advantage be raised as far as or beyond the plane of the upper surface of the rim of the carriage and transport ring. When the head surface of the vessel is located below the horizontal bearing surface of the carriage and transport ring, the minimum height of the conical shell part should, as already stated above, correspond to at least the height of the carriage and transport ring.

A slight reduction of this elevation may be acceptable for lighter vessels if a sufficient crumple zone is preserved.

DESCRIPTION OF THE PREFERRED EMBODIMENTS

Figure 1:
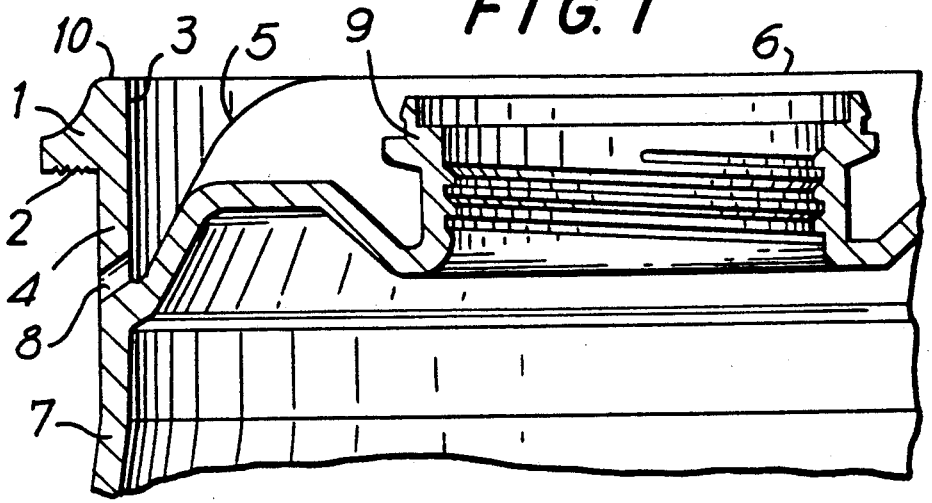
FIG. 1 shows a longitudinal section through the bung of a portion of the head section of a vessel.

In the drawing the cylindrical section of the shell of the vessel is labeled 7 and the head surface of the vessel of synthetic material is labeled 6. In the head surface of the vessel the bungs 9 are arranged in bung troughs.

Near the head surface 6 of the vessel lies a carriage and transport ring 1. A similar ring can be provided at the bottom end of the vessel. The ring is of solid cross-section with a horizontal bearing surface 2 and a vertical bearing surface 3 for the arms of a vessel lifter to be used and not shown in the drawing. In FIG. 1 the upper rim surface 10 of the carriage and transport ring 1 is flush with the head surface 6 of the vessel, while in FIG. 2 it protrudes over the head surface 6 of the vessel.

The carriage and transport ring 1 is connected in one piece with the shell of the vessel by a connecting web 4, which merges with the horizontal bearing surface 2. The bottom of the groove between the connecting web 4 and the section 5 of the shell rising conically towards the head surface 6 of the vessel is arranged at a distance below the horizontal bearing surface 2 of the carriage and transport ring 1.

Figure 2:
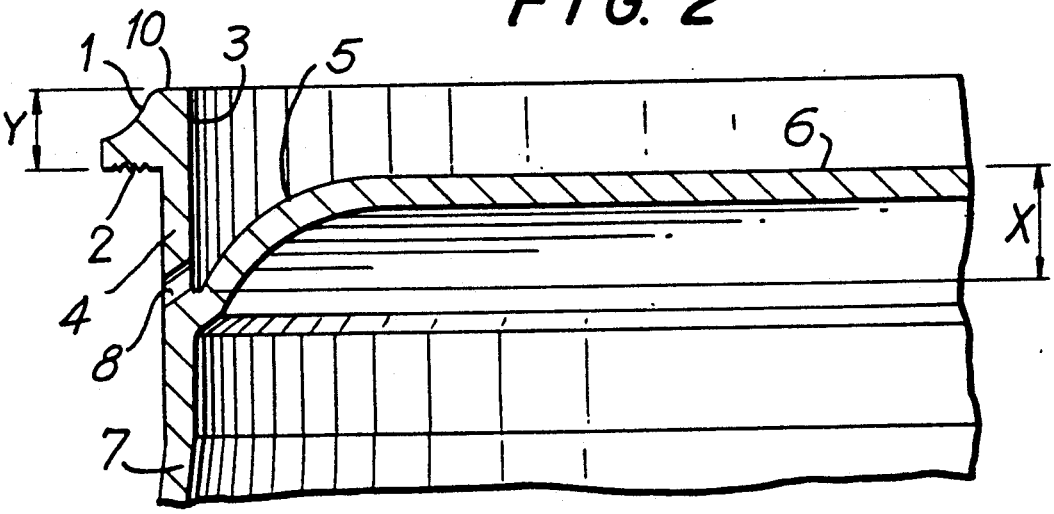
FIG. 2, a longitudinally section of the head section of a vessel with a lower top head surface.

If the head surface 6 of the vessel, as shown in FIG. 2, terminates below the horizontal bearing surface 2 of the carriage and transport ring 1, the height x of the conical shell part 5 corresponds to at least the height y of the carriage and transport ring 1.

The conicity is necessary because of the space requirement of the vessel lifter, and on the other hand the minimum height of the so-called crumple zone serves as a necessary zone of elasticity between head surface 6 and sidewall 7 of the vessel.

Figure 3:
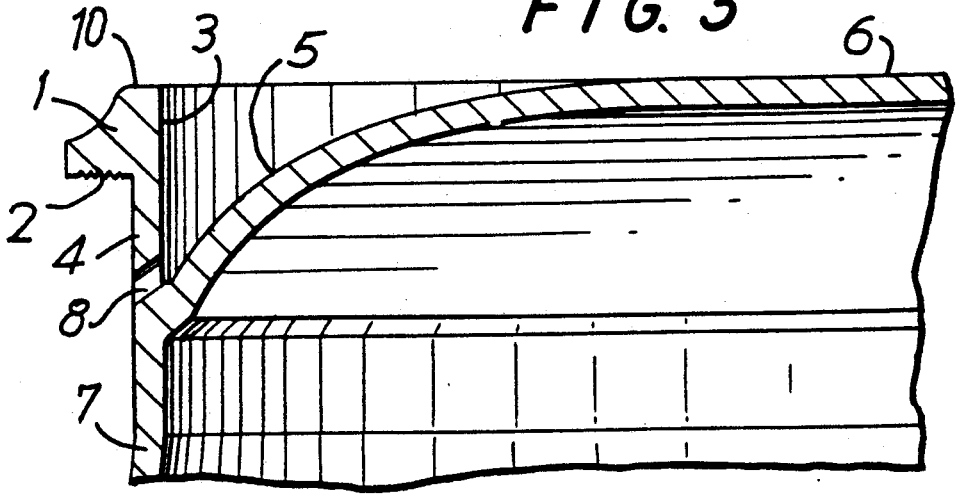
FIG. 3, a longitudinally section of the head section of a vessel with the head surface dished outwardly.

As shown in FIG. 3, the head surface 6 of the vessel is dished uniformly outward.

In the bottom of the connecting web 4 is arranged a passage 8 for drainage of water. The bottom of the groove may take an undulating course over the periphery of the vessel and is designed so that the passage or passages 8 are always located in a trough of the wave.

I claim:

1. A vessel of thermoplastic synthetic material having a central section, opposite head and bottom end surfaces, a frustoconical section connecting the central section to at least one of the end surfaces and at least one carriage and transport ring of solid cross-section, located on the shell of the vessel near said one end surface of the vessel and comprising a horizontal and a vertical bearing surface for the arms of a vessel lifter to be used in transporting the vessel, the carriage and transport ring being integrally formed with and connected to the vessel by a connecting web merging with the shell of the vessel and extending a distance axially along the shell of the vessel, joining the carriage and transport ring, the connecting web and the frustoconical section of the shell defining an annular groove therebetween, wherein the bottom of the groove between the connecting web (4) and the frustoconical section (5) rising conically towards the head surface (6) of the vessel is spaced axially below the horizontal bearing surface (2) of the carriage and transport ring (1), while the connecting web (4) is formed out of an axial lengthening of the central part (7) of the shell of the vessel.

2. The vessel of claim 1, wherein the axial outermost surface of the storage and transport ring extends at least to the height of the head of the vessel.

3. The vessel of claim 2, wherein the outer surface of the head of the vessel is axially beneath the horizontal bearing surface.

4. The vessel of claim 3, wherein the height of the frustoconical section is at least equal to the height of the carriage and transport ring.

5. A vessel according to claim 1, characterized in that the head surface (6) is dished uniformly outward.

6. A vessel according to claim 1 or 5, characterized in that at least one passage (8) is provided in the bottom of the connecting web (4) and leading outward of the vessel for drainage of water.

7. A vessel according to claim 6, characterized in that the bottom of the groove takes an undulating course over the periphery of the vessel with at least one passage (8) located in the bottom of the groove.

* * * * *

US005033639A

REEXAMINATION CERTIFICATE (2026th)

United States Patent [19]

Przytulla

[11] B1 5,033,639

[45] Certificate Issued May 25, 1993

[54] BUNGED VESSEL

[75] Inventor: Dietmar Przytulla, Sindorf, Fed. Rep. of Germany

[73] Assignee: Mauser-Werke GmbH, Bruhl, Fed. Rep. of Germany

Reexamination Request:
No. 90/002,699, Apr. 23, 1992

Reexamination Certificate for:

| | |
|---|---|
| Patent No.: | **5,033,639** |
| Issued: | **Jul. 23, 1991** |
| Appl. No.: | **154,735** |
| Filed: | **Feb. 11, 1988** |

[30] Foreign Application Priority Data

Jan. 21, 1988 [EP] European Pat. Off. ..... 88100868

[51] Int. Cl.[5] ..... B65D 6/00

[52] U.S. Cl. ..... 220/604; 220/659; 220/661; 220/675

[58] Field of Search ..... 220/604, 659, 661, 675, 220/DIG. 1; 222/108

[56] References Cited

U.S. PATENT DOCUMENTS

| | | | |
|---|---|---|---|
| 4,117,062 | 9/1978 | Uhlig | 264/94 |
| 4,140,236 | 2/1979 | Uhlig et al. | 220/71 |
| 4,252,585 | 2/1981 | Raabe et al. | 156/69 |
| 4,294,374 | 10/1981 | Ames | 220/649 |
| 4,412,628 | 11/1983 | Whitney | 220/71 |
| 4,713,207 | 12/1987 | Udell et al. | 264/515 |

FOREIGN PATENT DOCUMENTS

| | | |
|---|---|---|
| 15436/76 | 1/1978 | Australia . |
| 819446 | 12/1974 | Belgium . |
| 0210679 | 2/1987 | European Pat. Off. . |
| 7412047 | 7/1974 | Fed. Rep. of Germany . |
| 61-93038 | 5/1986 | Japan . |
| 8400951 | 10/1984 | Netherlands . |
| WO88/00128 | 1/1988 | PCT Int'l Appl. . |
| 1429754 | 3/1976 | United Kingdom . |
| 1535287 | 12/1978 | United Kingdom . |
| 2137158 | 10/1984 | United Kingdom . |

*Primary Examiner*—Gregory L. Huson

[57] ABSTRACT

Bunged vessel having solid carriage and transport rings formed in one piece with the shell of the vessel near the head surfaces of the vessel, wherein the horizontal lower edge of the ring and the vertical inner wall of the ring form the bearing surfaces for the vessel lifter. Each carriage and transport ring is connected in one piece with the vessel by a connecting ring formed of an axial prolongation of the cylindrical part of the shell of the vessel, while the bottom of the groove between the connecting ring and the part of the shell rising conically towards the head surface of the vessel is arranged at a distance below the horizontal bearing surface of the carriage and transport ring.

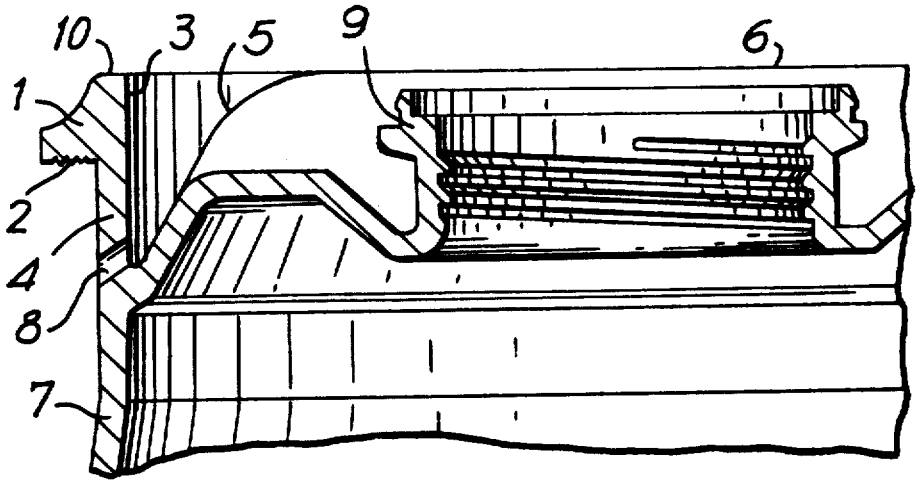

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3 and 5–7 are determined to be patentable as amended.

Claim 4, dependent on an amended claim, is determined to be patentable.

New claims 8–14 are added and determined to be patentable.

1. A vessel of thermoplastic synthetic material having a central section, opposite head and bottom end surfaces, a frustoconical section [connecting] *having an upper end and a lower end, with said lower end connected directly to* the central section *and said upper end connected* to at least one of the end surfaces, and at least one carriage and transport ring of solid cross-section, located on the shell of the vessel near said one end surface of the vessel and comprising a horizontal and a vertical bearing surface for the arms of a vessel lifter to be used in tranporting the vessel, the carriage and transport ring being integrally formed with and connected to the vessel by a connecting web *having an upper end and a lower end and* merging *at its lower end* with the shell of the vessel *below said one end surface*, and extending a distance axially along the shell of the vessel *and* joining the carriage and transport ring *at its upper end, the lower end of* the connecting web and *the lower end of* the frustoconical section of the shell *being joined together and* defining an annular groove therebetween, wherein the bottom of the groove between the connecting web (4) and the frustoconical section (5) rising conically towards the head surface (6) of the vessel is spaced axially below the horizontal bearing surface (2) of the carriage and transport ring (1), while the connecting web (4) is formed out of an axial lengthening of the central [part] *section* (7) of the shell of the vessel.

2. The vessel of claim 1, wherein the axial outermost surface of the [storage] *carriage* and transport ring extends at least to the height of the head *end surface* of the vessel.

3. The vessel of claim 2, wherein the outer surface of the head *end surface* of the vessel is axially beneath the horizontal bearing surface.

5. A vessel according to claim 1, characterized in that the head *end* surface (6) is dished uniformly outward.

6. A vessel according to claim 1 or 5, characterized in that at least one passage (8) is provided in the bottom of the connecting web (4) and leading outward of the [vessel] groove for drainage of water.

7. A vessel according to claim 6, characterized in that the bottom of the groove takes an undated course over the periphery of the vessel with at least one passage (8) located [in] *at* the bottom of the groove.

*8. A vessel according to claim 1, wherein the lower end of the frustoconical section and the lower end of the connecting web merge together, at the bottom of the groove, and into the central section of the vessel.*

*9. A vessel according to claim 8, wherein the thickness of the central section, the frustoconical section and the connecting web are the same.*

*10. The vessel according to any one of claims 1–5, 8 and 9, wherein the outer surface of the head of the vessel is located at a height at least equal to the height of the outermost surface of the carriage and transport ring.*

*11. The vessel according to claim 1, wherein the lower end of the connecting web has a radially inwardly facing surface extending axially of the central section of the vessel.*

*12. The vessel according to claim 1 wherein the connecting web has a uniform thickness throughout its length.*

*13. The vessel according to claim 1, 11 or 12, wherein the lower end of the connecting web and the lower end of the frustoconical section of the shell are joined directly together to define a V-shaped annular groove therebetween.*

*14. The vessel according to claim 13, wherein the lower end of the frustoconical section of the shell extends from the bottom of the V-shaped groove at an angle of about 30° from the lower end of the connecting web.*

* * * * *